US005181466A

United States Patent [19]

Ono

[11] Patent Number: 5,181,466

[45] Date of Patent: Jan. 26, 1993

[54] OFFSET PRINTING MACHINE HAVING AUTOMATICALLY RELEASABLY CLAMPED BLANKET SHEET

[75] Inventor: Yoshiaki Ono, Shizuoka, Japan

[73] Assignee: Tokyo Electric Co., Ltd., Tokyo, Japan

[21] Appl. No.: 858,874

[22] Filed: Mar. 27, 1992

[30] Foreign Application Priority Data

Mar. 29, 1991 [JP] Japan ..... 3-65790

[51] Int. Cl.[5] ..... B41F 9/00; B41L 47/14

[52] U.S. Cl. ..... 101/142; 101/450.1; 101/483; 101/477; 101/415.1

[58] Field of Search ..... 101/409, 415.1, 378, 101/DIG. 36, 477, 217, 475, 142, 450.1, 483

[56] References Cited

U.S. PATENT DOCUMENTS 3,563,176 2/1971 Ferguson ..... 101/415.1
3,773,551 11/1973 Kiener ..... 101/475
3,903,795 9/1975 Suzuki ..... 101/415.1
4,183,299 1/1980 Cappel ..... 101/415.1
4,581,993 4/1986 Schoneberger ..... 101/415.1
4,688,483 8/1987 Schollenberger ..... 101/415.1

*Primary Examiner*—Clifford D. Crowder
*Assistant Examiner*—Joseph R. Keating
*Attorney, Agent, or Firm*—Oblon, Spivak, McClelland, Maier & Neustadt

[57] ABSTRACT

An offset printing machine having a blanket sheet wrapped around an outer circumferential surface of a blanket cylinder 3 so as to come in contact with a master and having clamps 29 and 30 for releasably retaining opposite ends of the blanket sheet to the blanket cylinder 3. After ending a printing operation, the blanket sheet is removed from the clamps 29 and 30 and dumped. Accordingly, the cleaning of the blanket cylinder 3 can be omitted to prevent hands and clothes from being stained.

9 Claims, 7 Drawing Sheets

OFFSET PRINTING MACHINE HAVING AUTOMATICALLY RELEASABLY CLAMPED BLANKET SHEET

FIELD OF THE INVENTION AND RELATED ART STATEMENT

The present invention relates to an offset printing machine.

In an offset printing machine for depositing ink onto a master wrapped around an outer circumferential surface of a cylindrical master cylinder, transferring the ink deposited on the master to an outer circumferential surface of a cylindrical blanket cylinder, and transferring the ink transferred to the outer circumferential surface of the blanket cylinder to a sheet of paper, it is known that a blanket sheet having elasticity is attached on the outer circumferential surface of the blanket cylinder, so as to clearly transfer the ink on the blanket cylinder to the paper.

In general, the blanket sheet has a thickness of about 1.8 to 1.9 mm, and it is expensive so that the thickness must be controlled in an allowable range of ±0.03 mm to ensure the transfer of ink to the paper. Furthermore, as the thickness of the blanket sheet changes in long-term use, it is difficult to maintain an optimum transfer condition with respect to the paper, and various adjustments are therefore required. And further, the ink deposited on the blanket sheet after used must be washed off, which requires labor and stains hands and clothes.

OBJECT AND SUMMARY OF THE INVENTION

It is a first object of the present invention to omit the cleaning of the blanket sheet and prevent hands and clothes from being stained.

It is a second object of the present invention to use an inexpensive nonelastic material for the blanket sheet It is a third object of the present invention to easily discharge the master and the blanket sheet after use along a discharge passage in such a state that ink applied surfaces of the master and the blanket sheet are in contact with each other.

According to one aspect of the present invention, there is provided in an offset printing machine for depositing ink onto a master wrapped around an outer circumferential surface of a cylindrical master cylinder, transferring the ink deposited on the master to an outer circumferential surface of a cylindrical blanket cylinder, and transferring the ink transferred to the outer circumferential surface of the blanket cylinder to a sheet of paper; the improvement comprising a blanket sheet wrapped around the outer circumferential surface of the blanket cylinder so as to come in contact with the master, and a clamp for releasably retaining opposite ends of the blanket sheet to the blanket cylinder. Accordingly, after ending a printing operation, the blanket sheet can be removed from the clamp and dumped, so that the cleaning of the blanket sheet can be omitted, and the staining of hands and clothes can be prevented.

According to another aspect of the present invention, the above-mentioned offset printing machine further comprises an elastic member having a predetermined thickness attached on the outer circumferential surface of the blanket cylinder. Accordingly, tight contact of the blanket sheet with respect to the paper can be ensured by the elasticity of the elastic member to obtain a clear print. In this connection, the blanket sheet can be made of an inexpensive nonelastic material.

According to further aspect of the present invention, the above-mentioned offset printing machine further comprises a clamp for releasably retaining opposite ends of the master to the master cylinder, and a discharge passage extending along a tangent to a contact portion between the master cylinder and the blanket cylinder. Accordingly, after ending a printing operation, the master and the blanket sheet after used can be removed from the respective clamps and can be easily discharged along the discharge passage in such a state that the ink applied surfaces of the master and the blanket sheet are in contact with each other by rotating the master cylinder and the blanket cylinder.

DETAILED DESCRIPTION OF THE PREFERRED EMBODIMENTS

Figure 1:
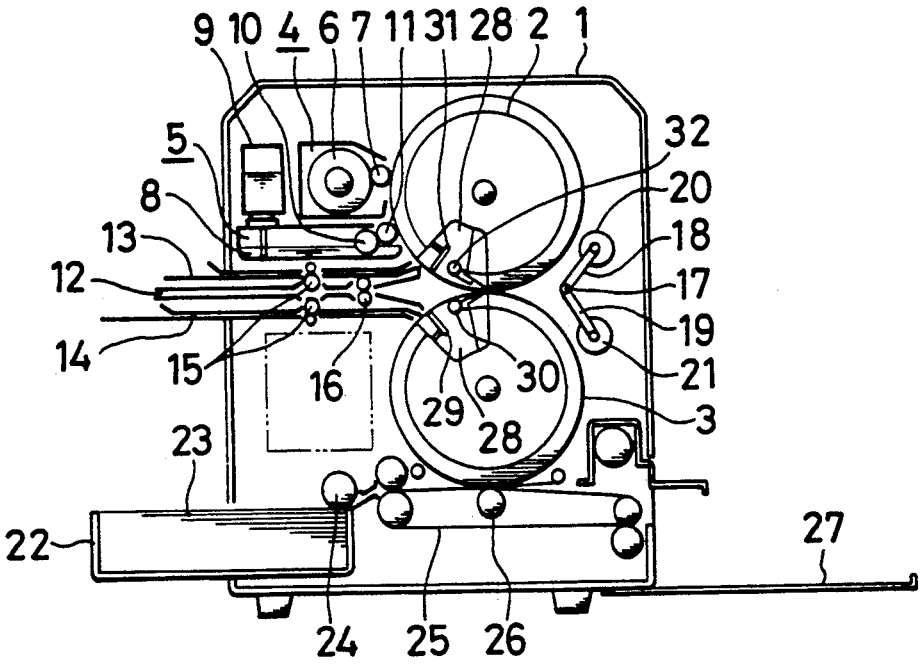
FIG. 1 is a side view illustrating an internal structure of an offset printing machine in a preferred embodiment according to the present invention.

A preferred embodiment according to the present invention will now be described with reference to the drawings. FIG. 1 is a side view illustrating an internal structure of an offset printing machine. In FIG. 1, reference numeral 1 denotes a body of the offset printing machine. The body 1 is provided with a master cylinder 2 and a blanket cylinder 3 both being rotatable about respective axes parallel to each other and being driven by respective reversible motors. In the vicinity of the master cylinder 2, an ink supply unit 4 and a dampening unit 5 are provided. The ink supply unit 4 has an ink supply roller 6 and an ink transfer roller 7. The dampening unit 5 has a container 8, a tank 9 for dropping water into the container 8 at a constant level, a Molton roller 10, and a water roller 11. A discharge passage 12 is provided so as to extend along a tangent to a contact portion between the master cylinder 2 and the blanket cylinder 3. Two insert passages 13 and 14 are provided so as to extend along upper and lower surfaces of the discharge passage 12. A master (described later) to be wrapped around the master cylinder 2 is adapted to be inserted through the insert passage 13, and a blanket sheet (described later) to be wrapped around the blanket cylinder 3 is adapted to be inserted through the insert passage 14. The master after being removed from the master cylinder 2 and the blanket sheet after being removed from the blanket cylinder 3 are adapted to be discharged through the discharge passage 12. The insert passages 13 and 14 are provided with respective feed rollers 15, and the discharge passage 12 is provided with a discharge roller 16. A pivot shaft 17 is disposed at a rear position on an extension of the discharge passage 12, and two links 18 and 19 are pivotably supported at respective base ends thereof to the pivot shaft 17. Two press rollers 20 and 21 are rotatably supported to the other ends of the links 18 and 19, respectively. The body 1 is provided at its lower portion with a paper cassette 22, a feed roller 24 for drawing a sheet of paper 23 out of the paper cassette 22, and a conveyor belt 25 for conveying the sheet of paper 23. An impression cylinder 26 is rotatably provided-in opposition to an outer circumference of the blanket cylinder 3 with the conveyor belt 25 interposed therebetween in such a manner that the impression cylinder 26 is moved upwardly in an printing operation. A printed paper receiving tray 27 is provided behind the body 1.

An opening portion 28 is formed at a part of the outer circumference of the blanket cylinder 3, and a pair of clamps 29 and 30 for retaining opposite ends of the blanket sheet are provided at opposed ends of the opening portion 28. Similarly, an opening portion 28' is formed at a part of the outer circumference of the master cylinder 2, and a pair of clamps 31 and 32 for retaining opposite ends of the master are provided at opposed ends of the opening portion 28'.

An opening and closing structure for the clamp 31 of the master cylinder 2 is identical with that for the clamp 29 of the blanket cylinder 3, and an opening and closing structure for the clamp 32 of the master cylinder 2 is identical with that for the clamp 30 of the blanket cylinder 3. Therefore, the opening and closing structures for the clamps 29 and 30 for the blanket cylinder 3 only will no be described.

Figure 2:
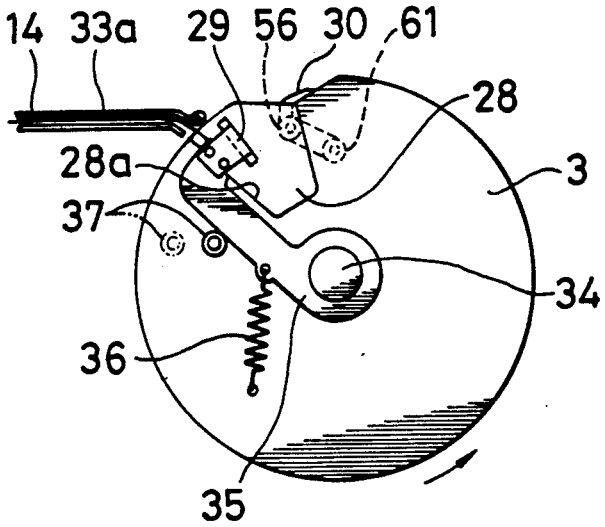
FIG. 2 is a schematic side view illustrating an opening and closing mechanism for a clamp for retaining a front end of a blanket sheet.

As shown in FIG. 2, a pivot shaft 34 projects from a side surface of the blanket cylinder 3 at the center thereof, and an arm 35 is pivotably supported to the pivot shaft 34. The clamp 29 for retaining a front end of the blanket sheet 33*a* is fixed to the tip of the arm 35. A spring 36 is stretched between the arm 35 and the side surface of the blanket cylinder 3. A bearing 37 is provided in opposition to the side surface of the blanket cylinder 3 so as to be displaceable in an axial direction and a radial direction of the blanket cylinder 3.

Figure 3:
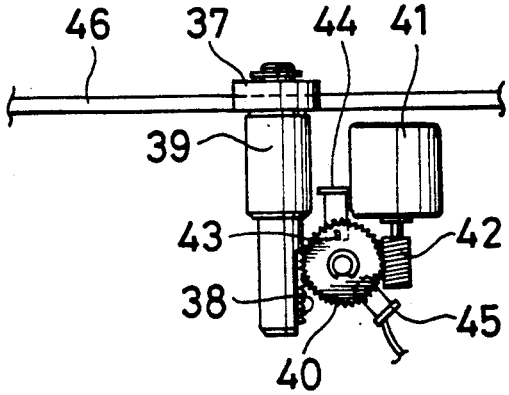
FIG. 3 is a plan view of the opening and closing mechanism shown in FIG. 3.
Figure 4:
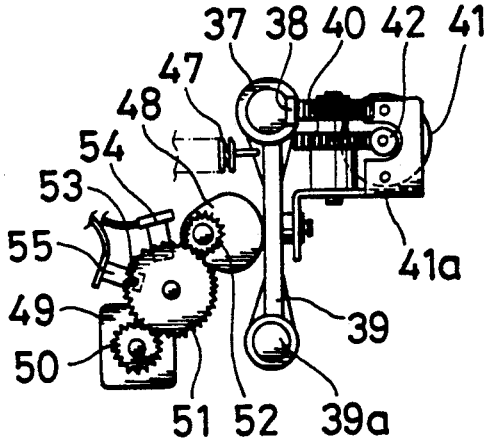
FIG. 4 is a side view of the opening and closing mechanism shown in FIG. 3.

As shown in FIG. 3, the bearing 37 is rotatably engaged with a rack 38. The rack 38 is slidably supported to a supporting frame 39. The rack 38 is meshed with a gear 40. The gear 40 is meshed with a gear 42 for transmitting rotation of a step motor 41. The gear 40 is provided with a slit 43 adapted to be detected by detectors 44 and 45. By detecting the slit 43 and controlling operation of the step motor 41, a direction and an amount of movement of the rack 38 are set. Reference numeral 46 denotes a right frame for supporting shaft portions projecting from right ends of the master cylinder 2 and the blanket cylinder 3. As shown in FIG. 4, the supporting frame 39 is pivotably supported to a pivot shaft 39*a*, and is biased by a spring 47 in a counterclockwise direction. A cam 48 is rotatably provided so as to contact a side surface of the supporting frame 39, and a plurality of gears 50, 51 and 52 meshing each other are provided to transmit rotation of a step motor 49 to the cam 48. The gear 51 is provided with a slit 53 adapted to be detected by detectors 54 and 55. By detecting the slit 53 and controlling operation of the step motor 49, a direction and an angle of rotation of the supporting frame 39 are set. Accordingly, the bearing 37 is displaced in the axial direction of the blanket cylinder 3 by the sliding operation of the rack 38, and the bearing 37 is displaced in the radial direction of the blanket cylinder 3 by the rotational operation of the supporting frame 39. As shown in FIG. 4, a bracket 41*a* is fixed to the supporting frame 39. The step motor 41 and the gear 40 are retained to the bracket 41*a*. Accordingly, even when the supporting frame 39 is rotated, the gear 40 and the rack 38 are always kept in mesh with each other.

Figure 5:
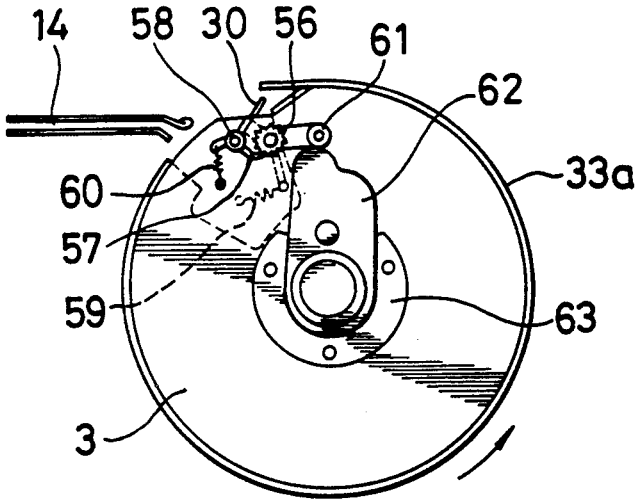
FIG. 5 is a side view illustrating an opening mechanism for a clamp for retaining a rear end of the blanket sheet.

As shown in FIG. 5, a ratchet 56 is rotatably supported to the side surface of the blanket cylinder 3. The clamp 30 for retaining a rear end of the blanket sheet 33*a* is adapted to be rotated together with the ratchet 56. A ratchet pawl 57 meshing the ratchet 56 is pivotably supported through a pivot shaft 58 to the side surface of the blanket cylinder 3. The clamp 30 is biased by a spring 59 in a closing direction (clockwise direction) about an axis of the ratchet 56, while the ratchet pawl 57 is kept in mesh with the ratchet 56 by a biasing force of a spring 60, so that the clamp 30 remains still in a fixed position. The clamp 30 has a bearing 61 rotating at a position separate from the center of rotation of the clamp 30. A cam 62 is provided in opposition to the side surface of the blanket cylinder 3 so a to be slidable in the axial direction of the blanket cylinder 3 as being guided by a guide 63.

Figure 6:
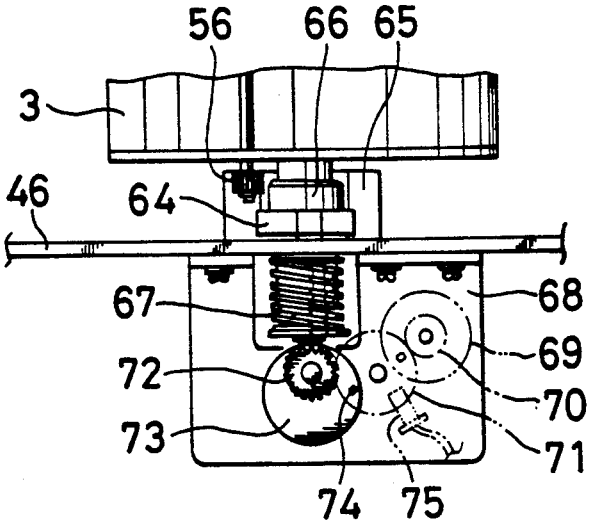
FIG. 6 is a plan view of the opening mechanism shown in FIG. 5.

As shown in FIG. 6, a cam shaft 66 fixed to the cam 62 is biased by a spring 67 in such a direction as to move away from the side surface of the blanket cylinder 3. A bracket 68 is fixed to the frame 46, and a step motor 69 is fixed to the bracket 68. A gear 70 is directly connected to the step motor 69, and the gear 70 is meshed with a gear 71. The gear 71 is meshed with a gear 72. The gear 72 is fixed to an eccentric cam 73. The gear 71 and the eccentric cam 73 are rotatably supported to the bracket 68. The cam shaft 66 contacts at on end thereof with an outer periphery of the eccentric cam 73. The gear 71 is formed with a slit 74 adapted to be detected by a detector 75 retained to the bracket 68. By detecting the slit 74 and controlling operation of the step motor 69, a direction and an amount of movement of the cam 62 are set.

Figure 7:
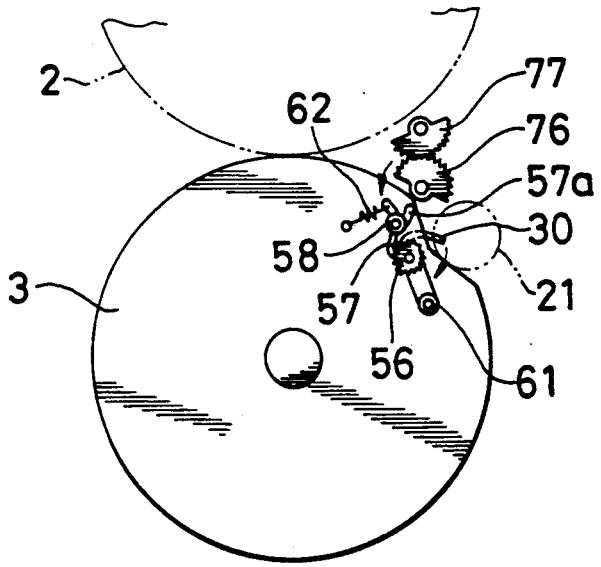
FIG. 7 is a side view illustrating a closing mechanism for the clamp shown in FIG. 5.
Figure 8:
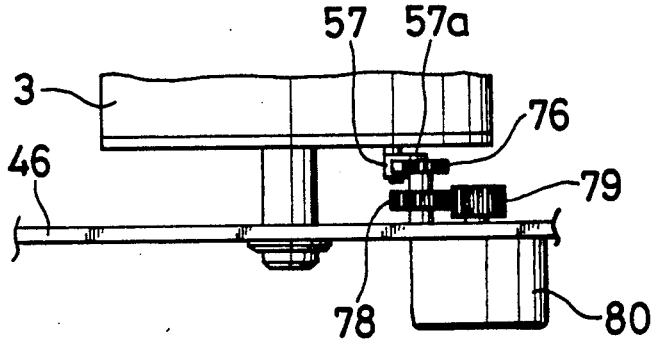
FIG. 8 is a plan view of the closing mechanism shown in FIG. 7.

As shown in FIG. 7, the ratchet pawl 57 has a projection 57*a*. The projection 57*a* is adapted to be kicked by a semicircular cam 76 for retracting the ratchet pawl 57 from the ratchet 56. The cam 76 has outer peripheral teeth meshing with outer peripheral teeth of another cam 77 identical in shape with the cam 76. The cam 77 serves to operate the clamp 32 for the master cylinder 2, and an object of provision of the cam 77 is the same as that of the cam 76 serving to operate the clamp 30 for the blanket cylinder 3. As shown in FIG. 8, a gear 78 rotating with the cam 76 is rotatably supported to the frame 46, and a gear 79 meshing with the gear 78 is adapted to be driven by a rotary solenoid 80 fixed to the frame 46.

Figure 9:
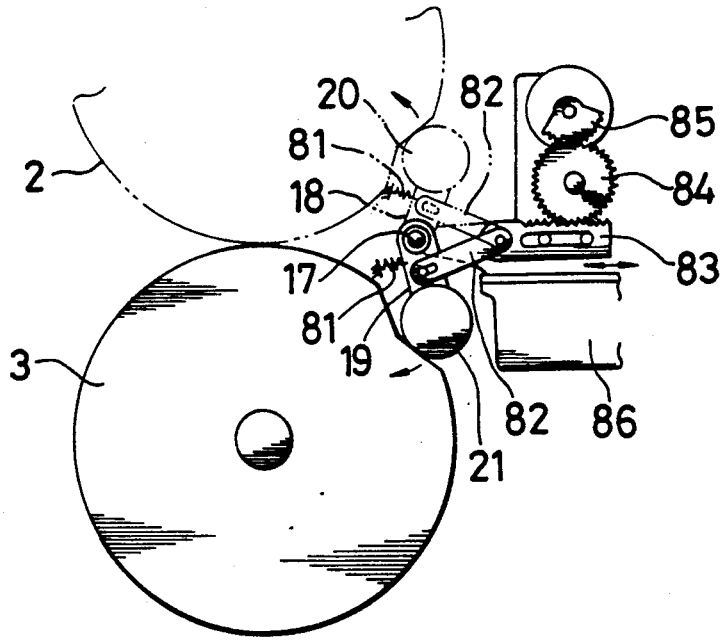
FIG. 9 is a side view illustrating a driving mechanism for press rollers.

As shown in FIG. 9, the links 18 and 19 respectively retaining the press rollers 20 and 21 are biased by two springs 81 toward the master cylinder 2 and the blanket cylinder 3, respectively. The links 18 and 19 are connected through two links 82 to a rack 83. The rack 83 is connected through gears 84 and 85 to a rotary solenoid 86.

Figure 10:
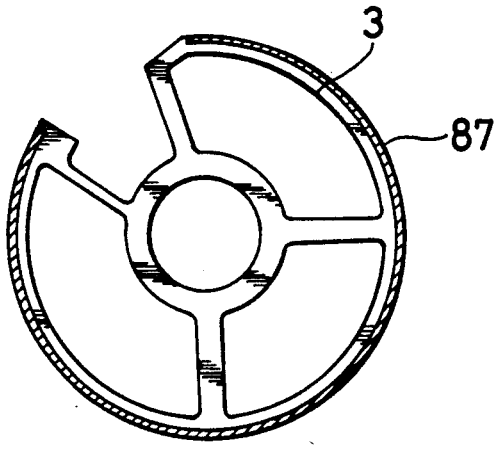
FIG. 10 is a side view illustrating an internal structure of a blanket cylinder.

The blanket cylinder 3 is made of aluminum or the like, and as shown in FIG. 10, an elastic sheet 87 made of rubber or the like is attached on the outer periphery of the blanket cylinder 3. The elastic sheet 87 is polished after being bonded to the blanket cylinder 3.

In starting a printing operation, the master 33*b* is wrapped around the master cylinder 2, and the blanket sheet 33*a* is wrapped around the blanket cylinder 3. Prior to such a wrapping operation, an initial process is carried out. That is, the initial process is to open the clamps 29, 30, 31 and 32. In the initial process, the gear 40 is rotated in the clockwise direction as viewed in FIG. 3 by the step motor 41 to move the rack 38. Accordingly, the bearing 37 engaged with the rack 38 at the tip portion thereof is approached to the side surface of the blanket cylinder 3 so as to advance into a locus of the arm 35. In this condition, the blanket cylinder 3 is driven in the counterclockwise direction as viewed in FIG. 2, so that the arm 35 rotating with the blanket cylinder 3 comes into abutment against the bearing 37 to stop. The blanket cylinder 3 is further driven from this abutting condition at a predetermined angle in the counterclockwise direction, so that there is created a space between an end surface 28*a* of the opening portion 28 and the tip of the clamp 29. Thus, the elamp 29 is opened.

On the other hand, referring to FIG. 6, the eccentric cam 73 is driven by the step motor 69, and the cam shaft 66 is urged toward the side surface of the blanket cylinder 3 against the biasing force of the spring 67, so that the cam 62 fixed to the cam shaft 66 is advanced into a locus of the bearing 61 of the clamp 30 as being guided by the guide 63. Accordingly, when the blanket cylinder 3 is driven in the counterclockwise direction as viewed in FIG. 5, the bearing 61 comes into interference with the cam 62 in the course of revolution of the clamp 30 together with the blanket cylinder 3, so that the clamp 30 is rotated about the axis of the ratchet 56 in the counterclockwise direction. Thus, the clamp 30 is opened. Even after the cam 62 passes the bearing 61 of the clamp 30, the rotation of the ratchet 56 is prevented by the ratchet pawl 57, so that the open condition of the clamp 30 is maintained. A similar initial process is also carried out for the clamps 31 and 32 of the master cylinder 2. A closing operation and a opening operation of the clamps 31 and 32 of the master cylinder 2 are similar to those of the clamps 29 and 30 of the blanket cylinder 3. Accordingly, the description of the course of the closing and opening operations of the clamps 31 and 32 of the master cylinder 2 will be omitted hereinafter, and there will be described the closing and opening operations of the clamps 29 and 30 of the blanket cylinder 3 only.

Figures 11A, 11B, 11C, 11D:
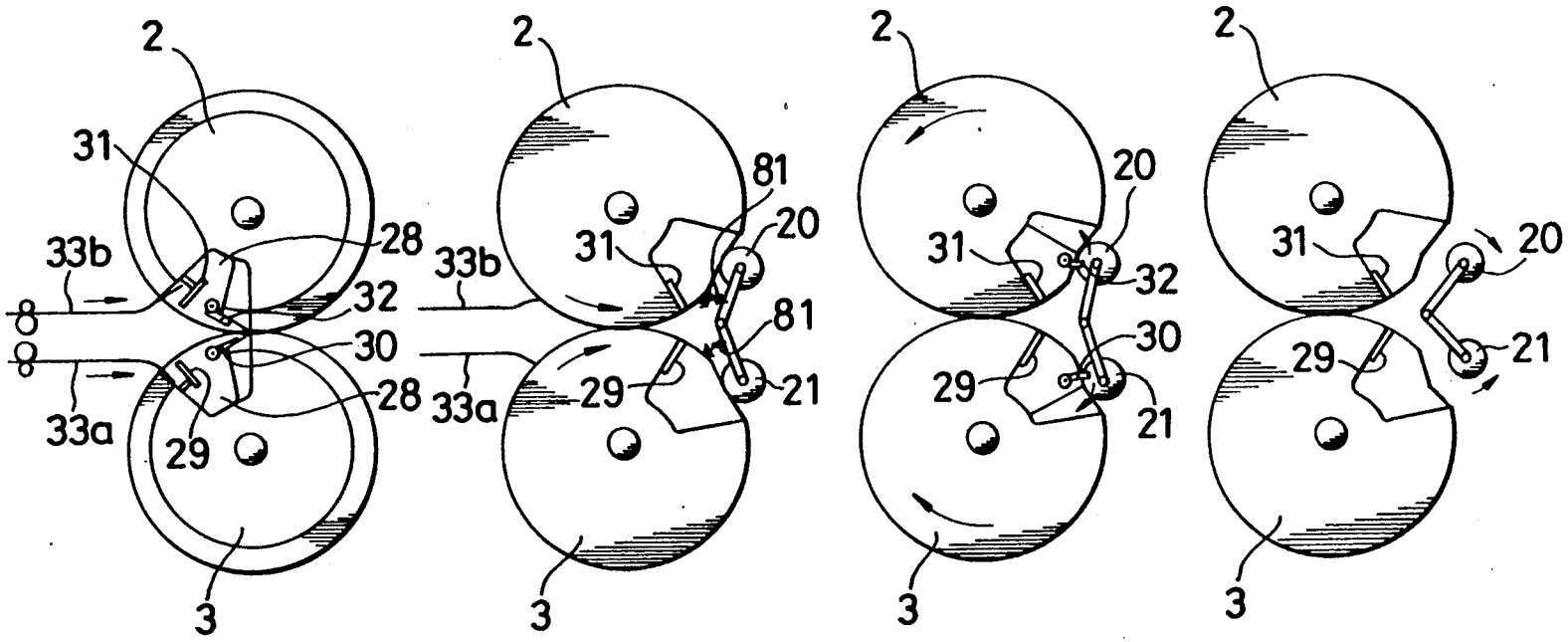
FIGS. 11(*a*), 11(*b*), 11(*c*) and 11(*d*) are side views illustrating a wrapping operation of the master and the blanket sheet.

As shown in FIG. 11(*a*), the master 33*b* is introduced from the insert passage 13, and the front end of the master 33*b* is inserted into the open clamp 31 of the master cylinder 2. On the other hand, the blanket sheet 33*a* is introduced from the insert passage 14, and the front end of the blanket sheet 33*a* is inserted into the open clamp 29 of the blanket cylinder 3. Then, both the clamps 29 and 31 are closed to fix the front ends of the blanket sheet 33*a* and the master 33*b*. That is, referring to FIG. 4, when the cam 48 is rotated by driving the step motor 49, the supporting frame 39 is rotated about the pivot shaft 39*a* in the counterclockwise direction by the biasing force of the spring 47. Accordingly, the bearing 37 as well as the rack 38 supported to the supporting frame 39 is retracted outwardly in the radial direction of the blanket cylinder 3 as shown by a phantom line in FIG. 2. As a result, the arm 35 is rotated in the counterclockwise direction by the biasing force of the spring 36, thereby closing the clamp 29.

Subsequently, as shown in FIG. 11(*b*), when the master cylinder 2 is driven in the counterclockwise direction and the blanket cylinder 3 is driven in the clockwise direction, the master 33*b* is wrapped around the master cylinder 2 and the blanket sheet 33*a* is wrapped around the blanket cylinder 3. During the rotation of the master cylinder 2 and the blanket cylinder 3, both the press rollers 20 and 21 are kept in pressure contact with the outer circumferences of the master cylinder 2 and the blanket cylinder 3 by the biasing force of the springs 81 to expand the master 33*b* and the blanket sheet 33*a*.

The rotation of the master cylinder 2 and the blanket cylinder 3 is continued until a rear end of the master 33*b* reaches the clamp 32 and a rear end of the blanket sheet 33*a* reaches the clamp 30 as shown in FIG. 11(*c*). When the rear ends of the master 33*b* and the blanket sheet 33*a* reach the clamps 32 and 30, respectively, the clamps 32 and 30 are closed. That is, referring to FIG. 8, the cam 76 is driven by the rotary solenoid 80, and referring to FIG. 7, the cam 76 is rotated in the counterclockwise direction to kick the projection 57*a* of the ratchet pawl 57. As a result, the ratchet 56 is allowed to freely rotate, and the clamp 30 is closed by the biasing force of the spring 59 (see FIG. 5). Thus, the rear ends of the master 33*b* and the blanket sheet 33*a* are fixed by the clamps 32 and 30.

Subsequently, as shown in FIG. 11(*d*), both the press rollers 20 and 21 are retracted from the outer circumferences of the master cylinder 2 and the blanket cylinder 3. That is, referring to FIG. 9, the rack 83 is moved rightwardly by the rotary solenoid 86, and the links 18 and 19 are accordingly pulled by the links 82 against the biasing force of the springs 81, thereby retracting the press rollers 20 and 21.

In this way, the master 33*b* is wrapped around the master cylinder 2 and the blanket sheet 33*a* is wrapped around the blanket cylinder 3, thus completing the preparation prior to the printing operation. In the printing operation, the water is supplied from the dampening unit 5 to the master 33*b*, and the ink is supplied from the ink supply unit 4 to the master 33*b*. At this time, an image portion of the master 33*b* repels the water and absorbs the ink only, and a non-image portion of the master 33*b* absorbs the water and repels the ink. Accordingly, when the master cylinder 2 and the blanket cylinder 3 are rotated the ink deposited on the master 33*b* is transferred to the blanket sheet 33*a*. On the other hand, the paper 23 drawn from the paper cassette 22 by the feed roller 24 and conveyed by the conveyor belt 25 is pressed to the blanket sheet 33*a* by the impression cylinder 26. Accordingly, the ink transferred to the blanket sheet 33*a* is transferred to the paper 23, and the paper 23 thus printed is ejected to the printed paper receiving tray 27

Figure 12A:
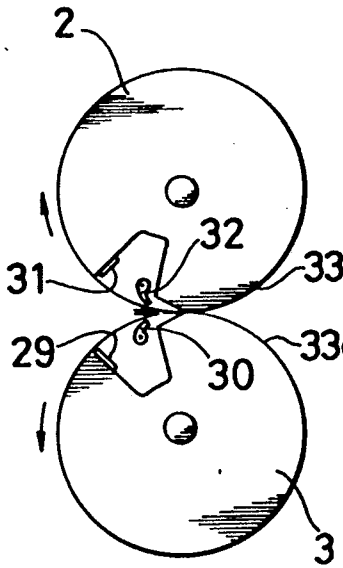
FIGS. 12(*a*), 12(*b*) and 12(*c*) are side views illustrating a recovering operation of the master and the blanket sheet.
Figure 12B:
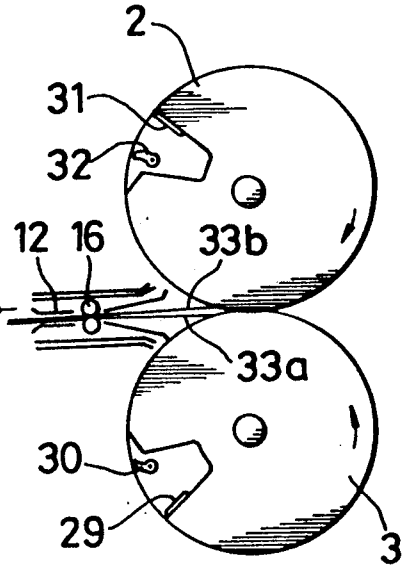
Figure 12C:
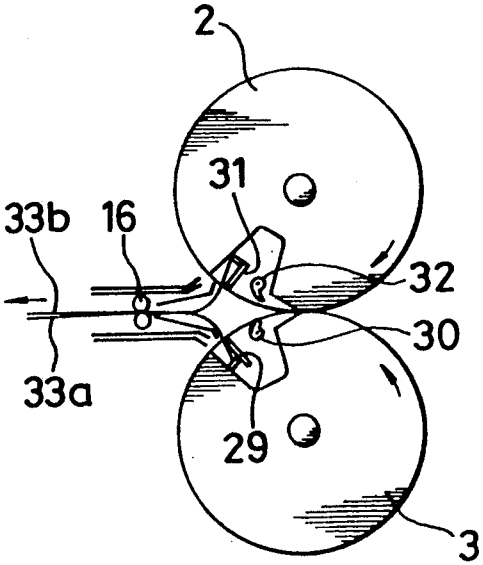

After the printing operation with the same master 33*b* is completed, the clamp 30 retaining the rear end of the blanket sheet 33*a* and the clamp 32 retaining the rear end of the master 33*b* are opened as shown in FIG. 12(*a*). That is, referring to FIG. 5, the cam 62 comes into interference with the bearing 61 of the clamp 30 in the course of rotation of the master cylinder 2 and the blanket cylinder 3 in the opposite directions as depicted by arrows.

In this open condition of the clamps 30 and 32, the master cylinder 2 and the blanket cylinder 3 are continued to be rotated, and the discharge roller 16 is also driven. Accordingly, as shown in FIG. 12(*b*), the master 33*b* and the blanket sheet 33*a* are discharged to the discharge passage 12 in such a state that the ink applied surfaces of the master 33*b* and the blanket sheet 33*a* are in contact with each other.

Just prior to ending of this discharge operation, both the clamps 29 and 31 are opened as shown in FIG. 12(*c*). That is, referring to FIG. 2, just prior to stopping of the blanket cylinder 3 at the fixed position, the bearing 37 is moved to the locus of the arm 35, so that the rotation of the arm 35 is stopped by the bearing 37 during the counterclockwise rotation of the blanket cylinder 3. Subsequently, the blanket cylinder 3 only is continued to be rotated in the counterclockwise direction until it reaches the fixed position.

As described above, after ending of the printing operation, not only the master 33*b* is removed from the master cylinder 2, but also the blanket sheet 33*a* is removed from the blanket cylinder 3. Furthermore, by rotating both the master cylinder 2 and the blanket cylinder 3, the master 33*b* and the blanket sheet 33*a* after used can be easily removed along the discharge passage 12 in such a state that the ink applied surfaces of the master 33*b* and the blanket sheet 33*a* are in contact with each other. Accordingly, the cleaning of the blanket cylinder 3 can be omitted.

Moreover, as the elastic sheet 87 is attached to the outer circumferential surface of the blanket cylinder 3, the blanket sheet 33*a* can come in tight contact with the paper 23, thereby clearly printing the paper 23. In this connection, the blanket sheet 33*a* can be made of an inexpensive nonelastic material.

According to the invention as defined in claim 1, there is provided in an offset printing machine for depositing ink onto a master wrapped around an outer circumferential surface of a cylindrical master cylinder, transferring the ink deposited on the master to an outer circumferential surface of a cylindrical blanket cylinder, and transferring the ink transferred to the outer circumferential surface of the blanket cylinder to a sheet of paper, the improvement comprising a blanket sheet wrapped around the outer circumferential surface of the blanket cylinder so as to come in contact with the master, and a clamp for releasably retaining opposite ends of the blanket sheet to the blanket cylinder. Accordingly, after ending a printing operation, the blanket sheet can be removed from the clamp and dumped, so that the cleaning of the blanket sheet can be omitted, and the staining of hands and clothes can be prevented.

According to the invention as defined in claim 2, the above-mentioned offset printing machine further comprises an elastic member having a predetermined thickness attached on the outer circumferential surface of the blanket cylinder. Accordingly, tight contact of the blanket sheet with respect to the paper can be ensured by the elasticity of the elastic member to obtain a clear print. In this connection, the blanket sheet can be made of an inexpensive nonelastic material.

According to the invention as defined in claim 3, the above-mentioned offset printing machine further comprises a clamp for releasably retaining opposite ends of the master to the master cylinder, and a discharge passage extending along a tangent to a contact portion between the master cylinder and the blanket cylinder. Accordingly, after ending a printing operation, the master and the blanket sheet after used can be removed from the respective clamps and can be easily discharged along the discharge passage in such a state that the ink applied surfaces of the master and the blanket sheet are in contact with each other by rotating the master cylinder and the blanket cylinder.

What is claimed is:

1. In an offset printing machine for depositing ink onto a master wrapped around an outer circumferential surface of a cylindrical master cylinder, transferring the ink deposited on the master to an outer circumferential surface of a cylindrical blanket cylinder, and transferring the ink transferred to the outer circumferential surface of a cylindrical blanket cylinder to a sheet of paper; the improvement comprising a blanket sheet wrapped around the outer circumferential surface of the blanket cylinder so as to come in contact with the master, and an automatically actuatable clamp means for releasably retaining opposite ends of said blanket sheet to the blanket cylinder; the offset printing machine further including a first passage means for feeding a blanket sheet to the blanket cylinder, a second passage means for feeding a master sheet to the master cylinder, a discharge passage means independent from said first and second passage means for receiving a blanket sheet after being released from said automatically actuatable clamp, said discharge passage means extending along a tangent to a contact portion between the master cylinder and the blanket cylinder, means for feeding a master sheet and a sheet blanket from said master cylinder and said blanket cylinder through said discharge passage means with the inked surfaces of the master sheet and blanket sheet facing each other.

2. The offset printing machine as defined in claim 1 further comprising an elastic member having a predetermined thickness attached on the outer circumferential surface of the blanket cylinder such that when a blanket sheet is wrapped around said blanket cylinder at least a portion of said blanket sheet overlies said elastic member.

3. The offset printing machine as defined in claim 1 or 2 further comprising a clamp means for releasably retaining opposite ends of the master to the master cylinder.

4. The offset printing machine of claim 1, wherein said discharge passage means is disposed between said first and second passage means.

5. The offset printing machine of claim 1, further including drive means opening and closing said clamp means.

6. The offset printing machine of claim 1, wherein a pair of clamp means are provided for clamping and releasing respective ends of said blanket sheet cam means for actuating said clamp means for selectively clamping and releasing said blanket sheet in timed relation such that one of the clamp means releases one end of the blanket sheet prior to release of the other clamp means.

7. The offset printing machine of claim 1, further including a drive means comprising a motor for controlling the clamp means between clamped and unclamped positions, and position determining means allowing said drive motor means to control accurate positioning of said clamp.

8. The offset printing machine of claim 3, wherein each of said blanket cylinder and master cylinder include drive means for controlling operation of respective clamp means of said blanket cylinder and master cylinder such that a master can be released from the master cylinder substantially simultaneous with release of a blanket sheet from the blanket cylinder such that a master and a blanket sheet can be discharged together through said discharge passage with respective inked surfaces of the blanket sheet and master in contact with one another.

9. A method for mounting and dismounting a blanket sheet upon a blanket cylinder in an offset printing machine comprising:

providing a blanket cylinder clamp means for automatically clamping and unclamping opposite ends of a blanket sheet;

feeding a blanket sheet to said blanket cylinder and automatically clamping one end thereof;

continuing feeding of said blanket sheet until the blanket sheet is disposed about the blanket cylinder and then automatically clamping the other end of the blanket sheet; and after a printing operation, automatically releasing an end of the blanket sheet and feeding said sheet into a discharge passageway adjacent to said blanket cylinder;

the method further including providing clamping means for automatically clamping and releasing a master on a master cylinder, and unclamping the master sheet substantially at the same time as the blanket sheet such that said blanket sheet and master have inked surfaces facing each other; and discharging said master and blanket sheets through said discharge passageway with their inked surfaces facing each other.

* * * * *